US005390709A

United States Patent [19]

Martonffy

[11] Patent Number: 5,390,709

[45] Date of Patent: Feb. 21, 1995

[54] FABRIC FORMING MACHINE INCLUDING PNEUMATIC SHEDDING APPARATUS AND METHOD

[76] Inventor: Barnabas Martonffy, 9219 Cameron Wood Dr., Charlotte, N.C. 28210

[21] Appl. No.: 991,101

[22] Filed: Dec. 16, 1992

[51] Int. Cl.[6] ..... D03C 3/22

[52] U.S. Cl. ..... 139/456; 139/317; 139/318; 66/232; 364/470; 364/921.1

[58] Field of Search ..... 364/921.1, 470; 139/455, 456, 317, 318, 55.1, 11 R, 59; 66/231, 232, 204, 205

[56] References Cited

U.S. PATENT DOCUMENTS

| | | | |
|---|---|---|---|
| 3,586,061 | 6/1971 | Lauritsen | 139/456 |
| 4,195,671 | 4/1980 | Bossut | 139/455 |
| 4,856,104 | 8/1989 | Stoll et al. | 66/232 X |
| 5,183,081 | 2/1993 | Kuster | 139/455 X |
| 5,246,040 | 9/1993 | Barwick et al. | 139/55.1 X |

OTHER PUBLICATIONS

Info Design, Inc., Vision Weaving, 88, All Pages.

Viable Systems, Inc., Viable Weavette, All Pages.

Somet Of America, Inc., Thema 11, 89, All Pages.

*Primary Examiner*—Andrew M. Falik

*Attorney, Agent, or Firm*—W. Thad Adams, III

[57] ABSTRACT

A shedding apparatus for being fitted onto a fabric-forming machine such as a loom for controlling the up and down movement of warp-carrying heddles to form a filling insertion zone. The shedding apparatus includes a computer for storing pattern information relating to a pre-determined pattern to be translated into a woven pattern on the fabric-forming machine. A plurality of pneumatic piston and cylinder assemblies are attached to respective heddles for pneumatically moving the heddle attached thereto into and out of shed-forming position. Pressurized air is delivered to predetermined piston and cylinder assemblies to thereby move the selected piston and cylinder assemblies and their respective heddles into upper and lower shed-forming positions to receive a filling yarn to thereby create a portion of the pattern.

17 Claims, 8 Drawing Sheets

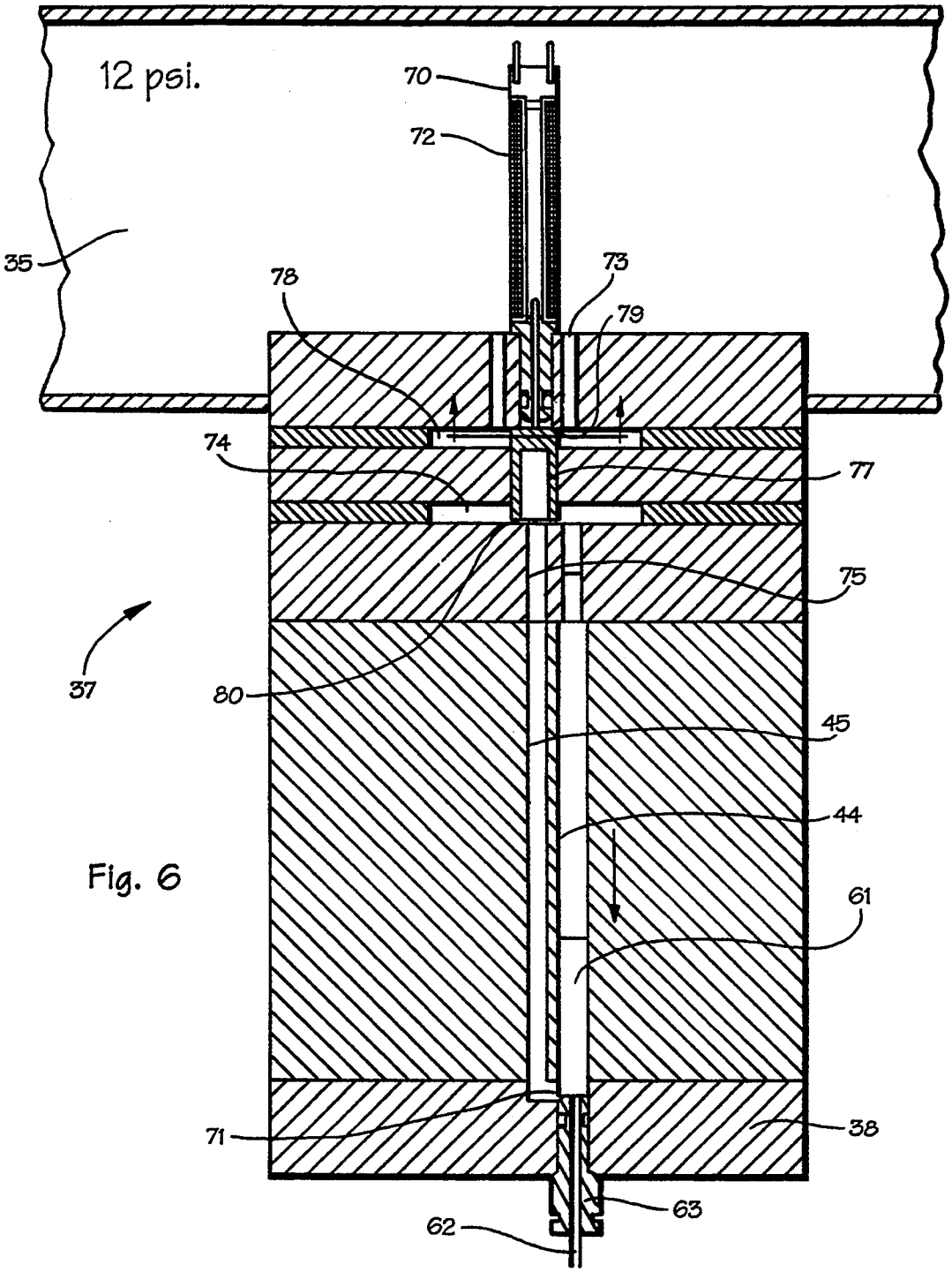
Fig. 6
Fig.6A
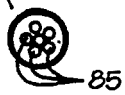

Heddle Position at Time (l)

a. Bottom to top
time(l):=

| | |
|---|---|
| 0 mm | 9.47 |
| | 13.57 |
| | 16.38 |
| | 17.92 |
| | 18.84 |
| | 20.99 |
| | 22.32 |
| | 22.94 |
| | 24.83 |
| | 25.65 |
| | 26.37 |
| | 27.02 |
| | 28.67 |
| | 28.47 |
| | 30.21 |
| | 30.72 |
| | 30.98 |
| | 32.77 |
| | 33.28 |
| 57 mm | 33.90 |

b. Top to bottom
time(l):=

| | |
|---|---|
| 57 mm | 12.50 |
| | 14.59 |
| | 18.18 |
| | 20.48 |
| | 22.02 |
| | 22.93 |
| | 24.58 |
| | 25.34 |
| | 26.45 |
| | 27.03 |
| | 28.67 |
| | 29.70 |
| | 30.46 |
| | 31.12 |
| | 32.77 |
| | 33.09 |
| | 33.63 |
| | 34.30 |
| | 34.62 |
| 0 mm | 36.86 |

FABRIC FORMING MACHINE INCLUDING PNEUMATIC SHEDDING APPARATUS AND METHOD

TECHNICAL FIELD AND BACKGROUND OF THE INVENTION

This invention relates to a shedding apparatus and method and fabric-forming machine and method which uses pneumatically-controlled and individually-programmable heddles. The invention is intended both for retro-fit onto existing conventional flat-weaving looms and other types of fabric-forming machines, and for incorporation into fabric-forming machines which may hereafter be developed, including those which may be developed specifically for use with the invention according to this application.

The apparatus and method according to the invention has the capability to control the shedding motion of each end in the warp individually to achieve the same result as a Jacquard loom. The shedding motion is created by electronically controlling the distribution of air pressure with solenoid valves to individual heddles, rather than by electronically controlling mechanical levers, as is the present practice. The design of the invention described in this application provides solutions to a number of problems.

The shedding motion of conventional Jacquard looms is cam controlled. As the operational limit of these types of looms is about 600 picks (filling insertions) per minute (ppm), it follows that the time for one shedding motion is 100 milliseconds. This is a limiting factor in the operation of the loom, since the fabric cannot be produced any faster than filling can be inserted and integrated into the warp yarns.

In contrast, the shedding motion for the invention described in this application is on the order of 35–40 milliseconds or less. Thus, consistent with other operating parameters, loom speed could be increased to the range of 1500 ppm. In addition, the shed formation is electronically controlled independent from the motion of the filling insertion apparatus, for example, the rapier on a rapier loom. Since the shed formation is electronically controlled, the shed position can be changed without changing the filling insertion apparatus.

Jacquard looms also have shedding motions which weave patterns with three or four repeats across the fabric because of the complex lever system of the Jacquard head. The invention according to this application can control every single warp end individually, enabling the loom to weave patterns with one repeat across the fabric. The invention of this application also does not require a gantry to hold the Jacquard head. This saves considerable overhead space, and will permit many weaving installations with low overhead space in the weave room to convert to weaving Jacquard-type fabrics by using the shed-forming apparatus and method disclosed and claimed below. The invention of this application is readily useable with known computer-aided pattern design systems. Examples are the Viable Weavette manufactured by Viable Systems, Inc. of Medfield, Mass., and the Vision Automatic pattern system manufactured by Info Design of New York.

The invention of this application is also adaptable to many different types of fabric-forming machines. Such machines include looms-for example, rapier, projectile, air jet, water jet and shuttle looms. As will be apparent, the particular type of filling insertion system is unimportant to the proper functioning of a fabric-forming machine according to the invention of this application. It is believed that the invention will have application in various forms of fabric formation.

The heddle system of the invention according to this application is manufactured in one piece, thereby making replacement very simple.

SUMMARY OF THE INVENTION

Therefore, it is an object of the invention to provide a shedding apparatus for being fitted onto a fabric-forming machine for controlling the up and down movement of warp-carrying heddles to form a filling insertion shed.

It is another object of the invention to provide a shedding apparatus which is electronically controlled and operates by pneumatic air pressure.

It is another object of the invention to provide a shedding apparatus which is simple to install, maintain and replace.

It is another object of the invention to provide a shedding apparatus which permits weaving of Jacquard-type fabrics on a much simpler and inexpensive fabric-forming apparatus.

It is another object of the invention to provide a shedding apparatus which individually controls the warp yarns but does not require a gantry.

It is another object of the invention to provide a shedding apparatus which is controllable independent of the filling insertion apparatus.

It is another object of the invention to provide a shedding apparatus which permits substantial increases in filling insertion rates by substantially increasing the speed of the shedding motion.

It is another object of the invention to provide a shedding apparatus which can control every single warp end individually, enabling the loom to weave patterns with one repeat across the fabric.

These and other objects of the present invention are achieved in the preferred embodiments disclosed below by providing a shedding apparatus for being fitted onto a fabric-forming machine for controlling the up and down movement of warp-carrying heddles to form a filling insertion shed. The shedding apparatus includes pattern information storage means for storing a predetermined pattern to be translated into a woven pattern on the fabric-forming machine and a plurality of pneumatic piston and cylinder assemblies for being attached to respective heddles for pneumatically moving the heddle attached thereto into and out of shed-forming position. Pattern information conveying means are operatively associated with the pattern storage means and responsive to the pattern storage means for delivering pressurized air to predetermined piston and cylinder assemblies to thereby move the selected piston and cylinder assemblies and their respective heddles into upper and lower shed-forming positions to receive a filling yarn to thereby create a portion of the pattern stored in the pattern information storage means.

According to one preferred embodiment of the invention, first pneumatic manifold means pneumatically cooperate with the pneumatic piston and cylinder assemblies and the pattern information conveying means. This maintains a pressurized air supply for use by each of the pneumatic piston and cylinder assemblies to move the selected piston and cylinder assemblies and their respective heddles into the upper shed-forming position to receive a filling yarn.

According to another preferred embodiment of the invention, the piston and cylinder assembly return means comprises a second pneumatic manifold for maintaining a pressurized air supply for use by each of the pneumatic piston and cylinder assemblies to move the selected piston and cylinder assemblies and their respective heddles into the lower shed-forming position to receive a filling yarn.

According to yet another preferred embodiment of the invention, the pattern storage means comprises a computer having digital storage means and data reading means for reading digital data representing the predetermined pattern from storage. The pattern conveying means comprises a plurality of solenoids operatively associated with the computer and with the respective plurality of piston and cylinder assemblies.

According to yet another preferred embodiment of the invention, the piston and cylinder assemblies are housed in a piston block, the piston block defining a plurality of cylinders formed therein for receiving a respective piston for pneumatically induced shed-forming movement therein between the upper and the lower shed-forming positions.

According to yet another preferred embodiment of the invention, the pneumatic piston and cylinder assembly comprises a top manifold for maintaining a supply of air and a bottom manifold for maintaining a supply of air. The bottom manifold is vertically spaced-apart from the top manifold and defines a shed-forming space therebetween wherein the heddles move upwardly and downwardly to form successive filling insertion sheds as weaving proceeds. A top piston block is positioned in pneumatic communication with the top manifold. The top piston block has a plurality of cylinders formed therein. A top piston is positioned in each of the cylinders for pneumatically-induced movement therein. A bottom piston block is positioned in pneumatic communication with the bottom manifold, the bottom piston block having a plurality of cylinders formed therein. A bottom piston is positioned in each of the cylinders for pneumatically-induced movement therein. Interconnection means are provided for interconnecting one of the top pistons and one of the bottom pistons for unison, pneumatically-induced shed-forming movement of the top and bottom pistons. The interconnection means include a heddle.

An embodiment of the method of forming a shed on a fabric-forming machine according to the invention includes the steps of storing a predetermined pattern to be translated into a fabric pattern on the fabric-forming machine and delivering pressurized air to predetermined heddles in correlation with the pattern to thereby move the heddles into upper and lower shed-forming positions to receive a filling yarn to thereby create a portion of the pattern stored in the pattern information storage means.

According to one preferred embodiment of the invention, the step of storing a predetermined pattern comprises the steps of providing a computer having digital storage means, and storing the an electromagnetic representation of the pattern in the digital storage means.

According to another preferred embodiment of the invention, the step of delivering pressurized air to predetermined heddles comprises the steps of providing data reading means for reading digital data from the digital storage means, providing a plurality of solenoids operatively associated with the computer and with the heddles, and activating the solenoids in response to data read from the digital storage device to deliver pressurized air to heddles in a pattern corresponding to the pattern of the warp of the fabric to be woven.

According to yet another preferred embodiment of the invention, the step of activating the solenoids comprises the step of providing piston and cylinder assemblies housed in a piston block. The piston block defines a plurality of cylinders formed therein for receiving a respective piston which is interconnected with a respective heddle for inducing movement of the heddle.

According to one preferred embodiment of the invention, a fabric-forming machine is provided for inserting yarn into a filling insertion shed. The fabric-forming machine includes warp yarn delivery means for delivering warp yarns to a filling yarn insertion zone and filling yarn delivery means for delivering filling yarns to the filling yarn insertion zone for integration with warp yarns delivered to the filling yarn insertion zone to form a fabric. Fabric removal means progressively remove the fabric formed from the filling yarn insertion zone. Shed-forming means form a filling insertion shed in the filling yarn insertion zone. The shed-forming means include pattern information storage means for storing a pre-determined pattern to be translated into a woven pattern on the fabric-forming machine. A plurality of pneumatic piston and cylinder assemblies are attached to respective heddles for pneumatically moving the heddle attached thereto into and out of shed-forming position. Pattern information conveying means are associated with the pattern storage means and are responsive to the pattern storage means for delivering pressurized air to predetermined piston and cylinder assemblies to thereby move the selected piston and cylinder assemblies and their respective heddles into upper and lower shed-forming positions to receive a filling yarn. A portion of the pattern stored in the pattern information storage means is thereby replicated in the fabric.

According to yet another preferred embodiment of the invention, a first pneumatic manifold means pneumatically cooperates with the pneumatic piston and cylinder assemblies and the pattern information conveying means for maintaining a pressurized air supply for use by each of the pneumatic piston and cylinder assemblies to move the selected piston and cylinder assemblies and their respective heddles into the lower shed-forming position to receive a filling yarn.

Preferably, piston and cylinder assembly return means includes a second pneumatic manifold for maintaining a pressurized air supply for use by each of the pneumatic piston and cylinder assemblies to move the selected piston and cylinder assemblies and their respective heddles into the upper shed-forming position to receive a filling yarn.

Preferably, the pattern storage means includes a computer having digital storage means and data reading means for reading digital data representing the predetermined pattern from storage, and the pattern conveying means includes a plurality of solenoids operatively associated with the computer and with the respective plurality of piston and cylinder assemblies.

According to one preferred embodiment of the invention, piston and cylinder assemblies are housed in a piston block. The piston block defines a plurality of cylinders formed therein for receiving a respective piston for pneumatically induced shed-forming movement therein between the upper and the lower shed-forming positions.

Preferably, the pneumatic piston and cylinder assembly includes a top manifold for maintaining a supply of air and a bottom manifold for maintaining a supply of air. The bottom manifold is vertically spaced-apart from the top manifold and defines a shed-forming space therebetween wherein the heddles move upwardly and downwardly to form successive filling insertion sheds as weaving proceeds. A top piston block is positioned in pneumatic communication with the top manifold, and the top piston block has a plurality of cylinders formed therein. A top piston is positioned in each of the cylinders for pneumatically-induced movement therein. A bottom piston block is positioned in pneumatic communication with the bottom manifold. The bottom piston block has a plurality of cylinders formed therein. A bottom piston is positioned in each of the cylinders for pneumatically-induced movement therein. Interconnection means interconnect one of the top pistons and one of the bottom pistons for unison, pneumatically-induced shed-forming movement of the top and bottom pistons. The interconnection means include a heddle.

An embodiment of the method according to the invention comprises the steps of storing a predetermined pattern to be translated into a fabric pattern, delivering warp yarns to a filling yarn insertion zone, and delivering pressurized air to air-responsive movement means associated with predetermined heddles positioned at the filling yarn insertion zone in correlation with the pattern to thereby move the heddles into upper and lower shed-forming positions in the filling insertion zone to receive a filling yarn to thereby create in a fabric the pattern stored in the pattern information storage means. The filling yarns are delivered into the filling yarn insertion zone, and the filling yarns are integrated with the warp yarns to form a fabric.

According to one preferred embodiment of the invention, the step of storing a predetermined pattern includes the steps of providing a computer having digital storage means and storing the an electromagnetic representation of the pattern in the digital storage means.

According to another preferred embodiment of the invention, the step of delivering pressurized air to predetermined heddles includes the steps of providing data reading means for reading digital data from the digital storage means, providing a plurality of solenoids operatively associated with the computer and with the heddles, activating the solenoids in response to data read from the digital storage device to deliver pressurized air to heddles in a pattern corresponding to the pattern of the warp of the fabric to be woven.

According to one preferred embodiment of the invention, the step of activating the solenoids comprises the step of providing piston and cylinder assemblies housed in a piston block, the piston block defining a plurality of cylinders formed therein for receiving a respective piston which is interconnected with a respective heddle for inducing movement of the heddle.

According to another preferred embodiment of the invention, the step of integrating the filling yarns and warp yarns to form the fabric comprises the step of forming a flat woven fabric.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 6 is a fragmentary enlarged cross-sectional view of the top manifold and piston block with the piston and heddle assembly in its "down" position;

FIG. 6A is a fragmentary cross-sectional view of the plunger showing the airway configuration of the plunger;

DESCRIPTION OF THE PREFERRED EMBODIMENT AND BEST MODE

Figure 1:
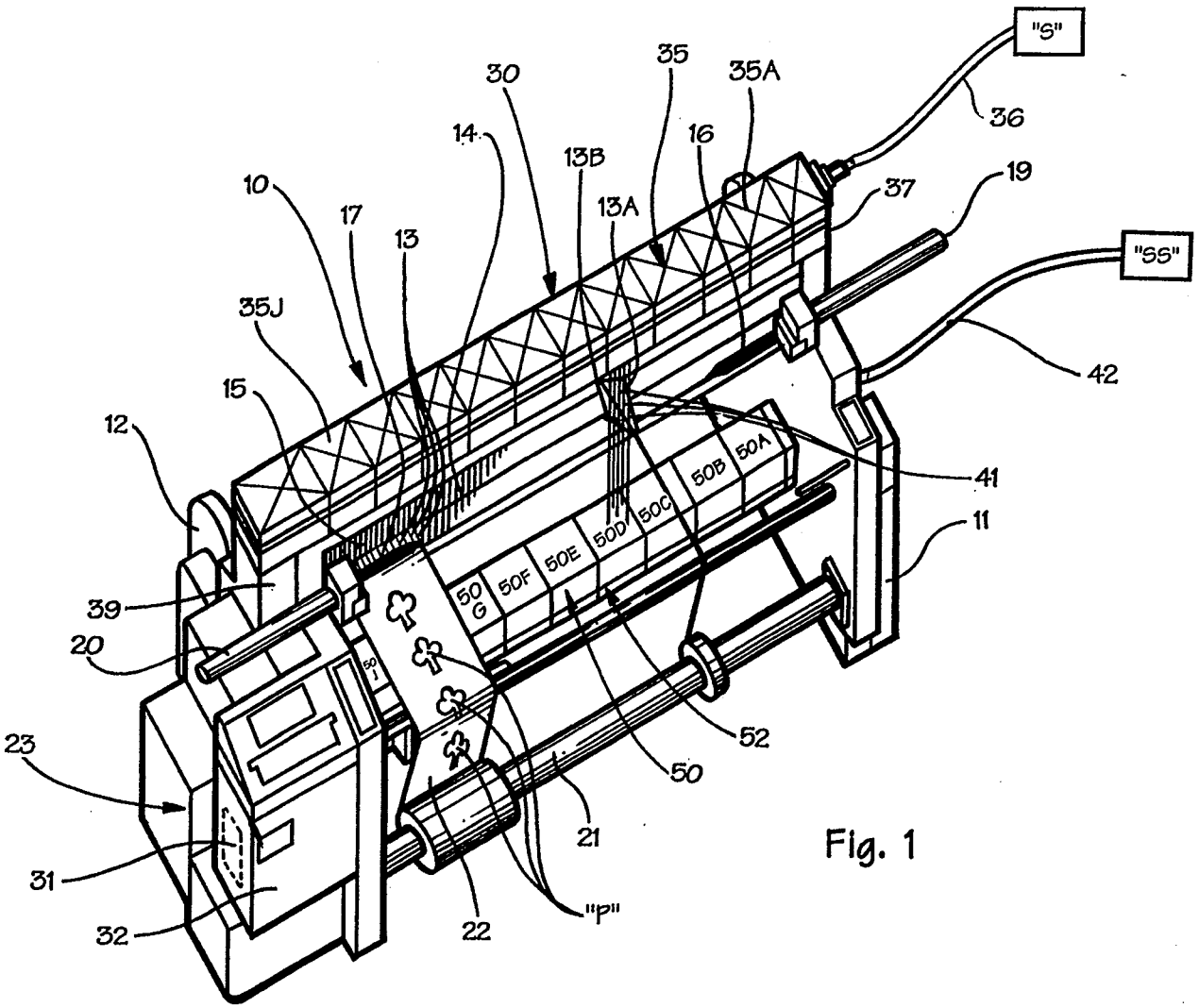
FIG. 1 is a perspective view of a loom with a shedding apparatus according to a preferred embodiment of the invention installed thereon.

Referring now specifically to the drawings, a loom with a shedding apparatus according to the present invention is illustrated in FIG. 1 and shown generally at reference numeral 10. Loom 10 includes a frame 11 which carries a warp beam 12 on which are wrapped warp yarns 13. Warp yarns 13 extend through a reed 14 and into a filling insertion zone 15 forward of the reed 14. Filling yarn is supplied by filling yarn supply packages (not shown) and is inserted into the filling insertion zone 15 by a pair of rapiers 16 and 17. Rapiers 16 and 17 are housed in and reciprocate into and out of tubes 19 and 20. One of the rapiers 16 or 17 receives a filling yarn from a filling yarn supply package and carries it through the filling insertion zone 15 to the center of the loom 10, where it is transferred to the other of the rapiers 16 or 17, which has moved through the filling insertion zone 15 from the other direction to meet in the center of the filling insertion zone 15. A noted above, any suitable form of filling insertion technique can be used. The double-rapier-type of filling insertion is merely shown by way of example.

A take-up beam 21 rotates to take up fabric 22 as it is woven on loom 10, and to keep proper tension on the warp yarns 13 as the weaving process takes place. The loom 10 is powered by an electric motor through appropriate gearing, shown broadly at 23. Since these components are conventional, they will not be further elaborated upon.

A shed is formed in the filling insertion zone 15 by a shedding apparatus 30 according to the present invention. As in conventional shedding devices, the shed is formed by lifting and lowering certain of the warp yarns 13 in a predetermined way, according to a pattern. The raised and lowered warp yarns 13 form an upper and lower "sheet" of warp yarns 13*a* and 13*b* which define between them the filling insertion zone 15. Typically, a shedding motion occurs between each filling insertion, so that the filling yarns are locked into the warp, thus forming the fabric 22. A fabric pattern "P" is created by moving the warp yarns 13 up and down between each filling insertion according to a predetermined pattern.

The variation of the colors of the warp yarns 13 and the sequence of movement of the warp yarns 13 results in the replication of the predetermined pattern "P" in the fabric 22 produced on the loom 10. The pattern "P" contains information regarding both the color or texture pattern which will be created in the fabric 22, and the actual "weave" of the fabric 22, i.e., whether the fabric 22 will be a twill, basket weave, or other fabric construction. The weave pattern "P" is generated by computer using CAD/CAM software which converts a design into a digital representation of the design, which can then be stored on a magnetic disk. Shedding apparatus 30 is controlled by a computer 31 housed in an electronics bay 32 on the loom 10. The disk containing the pattern is read by the computer 31 on an individual loom 10 and is stored in RAM in blocks of 512 units.

As is generally shown in FIG. 1, shedding apparatus 30 is constructed of a top air manifold 35 connected to an air supply "S" through an air hose 36. Top air manifold 35 is formed of 10 top air manifold modules 35A–35J mounted on top of a top piston block 37, which is formed of 10 top piston block modules 37A–37J. The top air manifold 35 and the top piston block 37 are mounted on and carried by loom 10 in a position above the filling insertion zone 15. In the embodiment shown in FIG. 1, each of the 10 top piston block modules 37A–J contains provision for 512 heddles (32 side-to-side and 16 front-to-back), each of which can be individually controlled. Thus, the top piston block 37 is capable of individually controlling 5120 heddles. As is shown in FIG. 2, each top piston block module 37A–J is enclosed on the bottom by a respective bottom cover 38A–J.

Figure 2:
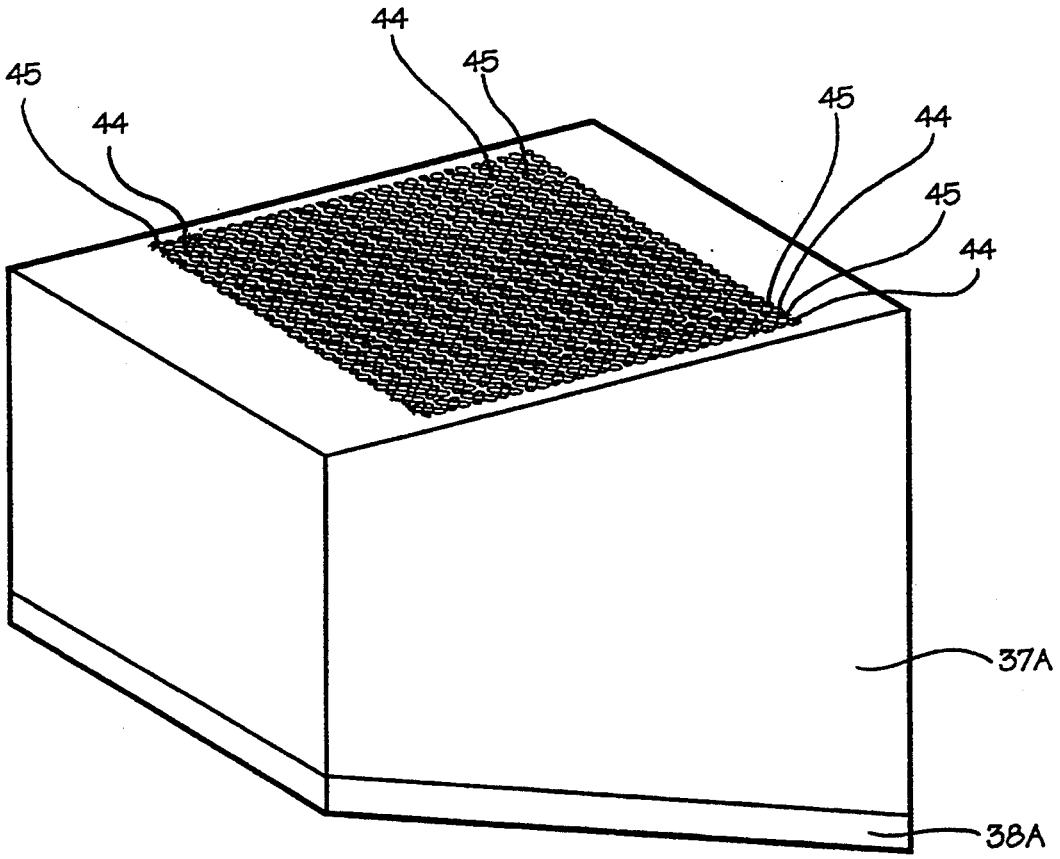
FIG. 2 is a perspective view of a section of the top piston block according to the embodiment of the invention shown in FIG. 1.
Figure 3:
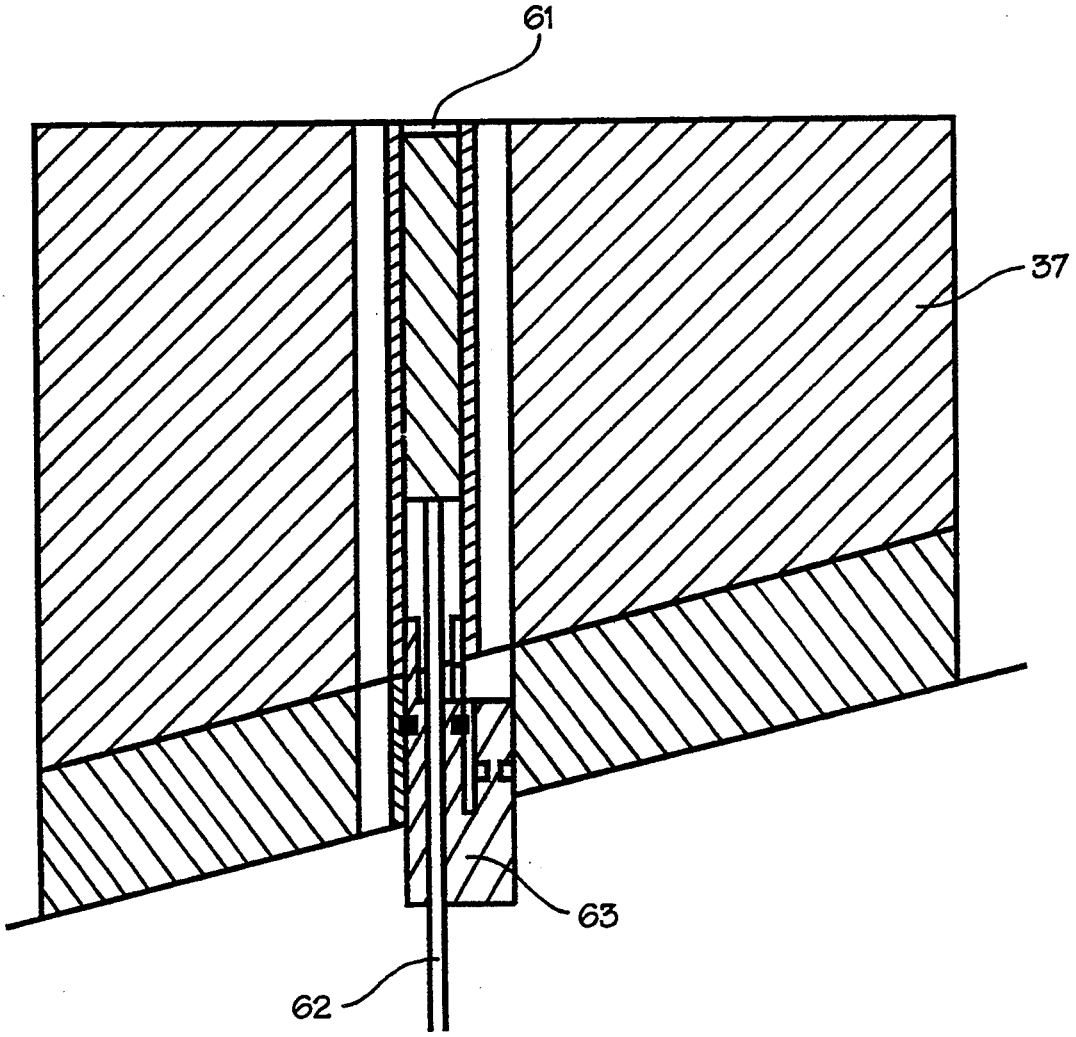
FIG. 3 is a fragmentary vertical cross-section of the top piston block of FIG. 2.

Referring now to FIG. 2, a single top piston block module 37A illustrative of each of the top piston block modules 37A–37J is shown. As noted above, each piston block module 37A–J has provision for 512 heddles.

Figure 4:
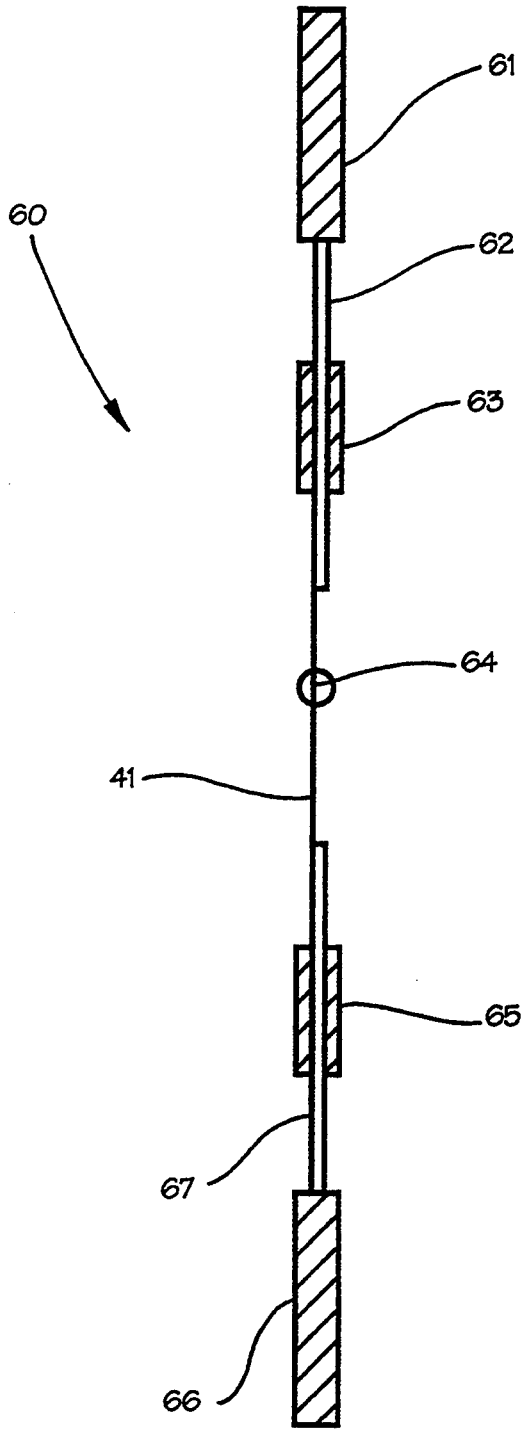
FIG. 4 is a vertical cross-section of the piston and heddle assembly.

Referring to FIGS. 2 and 4, each heddle 41 requires a cylinder 44 and an associated vent 45, so that in each piston block module 37A–J there is formed 512 cylinders 44 and 512 vents 45. The top air manifold module 35A is attached to the top of the piston block module 37A and is sealed to it against air flow. Thus, the area above the top piston block 37 becomes a single air chamber which communicates with the entire enclosed volume under the top air manifold 35. In the embodiment disclosed in this application, positive air pressure of approximately 16 psi is delivered from the air supply "S" via air hose 36 to the air chamber defined above the top piston block 37. Note that the top piston block 37 is wedge-shaped, thus creating a corresponding wedge-shaped void in the filling insertion zone 15.

Figure 5:
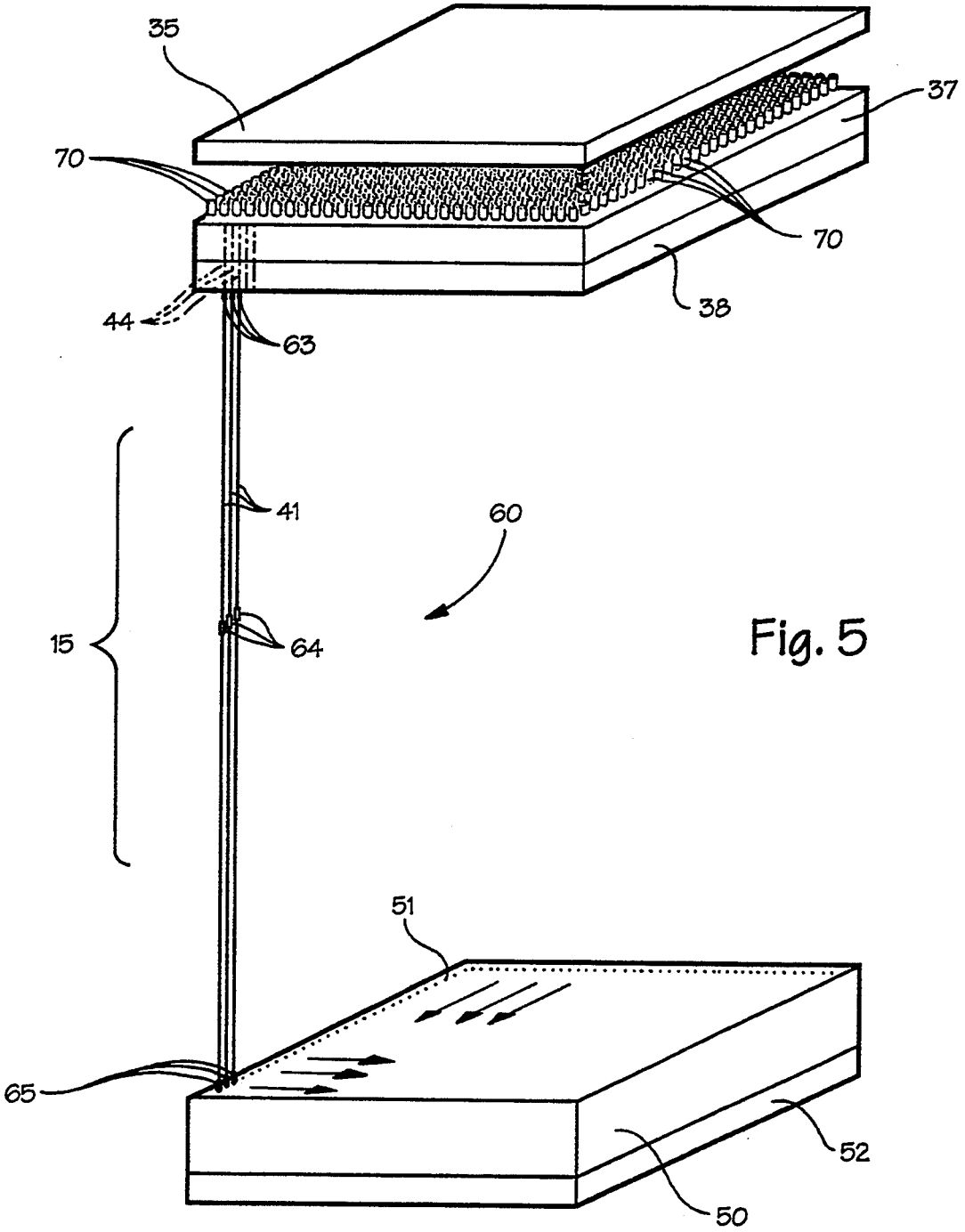
FIG. 5 is a schematic view showing the relationship of the piston and heddle assemblies to the top and bottom manifolds and top and bottom piston blocks.

Referring now to FIG. 5, a bottom piston block 50 is mounted on and carried by loom 10 below the filling insertion zone 15 and the top piston block 37. The bottom piston block 50 is connected to an air supply "SS" by an air hose 42. The distance between the bottom piston block 50 and the top piston block 37 defines the filling insertion zone 15, and heddles 41 corresponding to the number of warp yarns 13 being woven are lifted and lowered by the shedding apparatus 30. Of course, as many warp yarns 13 as there are heddles 41 can be woven at any one time, assuming a single warp yarn 13 per heddle 41. There are, however, patterns and weave constructions which include doubling warp yarns 13 through some or all heddles 41. In the illustration shown in FIG. 1, only very narrow fabrics are shown so that more of the loom 10 is thus seen.

The bottom piston block 50 is comprised of 10 bottom piston block modules 50A–50J, which are arrayed next to each other in the manner shown in FIG. 1. Bottom piston block 50 is aligned in vertical registration with the top piston block 37. Each bottom piston block module 50A–50J has 512 cylinders 51 therein—one for each of 512 heddles 41 to be operated. Each cylinder 51 extends through the bottom piston block 50 from top to bottom. The bottom piston block 50 is enclosed by a bottom manifold cover 52 which forms a single air chamber therein. In the embodiment described in this application, an air pressure of approximately 4 psi is created in the air chamber.

As is also illustrated in FIG. 5, one of the heddles 41 is positioned intermediate each of the cylinders 44 and 51. The central portion of the heddle 41 defines the area of the filling insertion zone 15.

Referring now to FIG. 4, each heddle 41 according to the embodiment of the invention is part of a heddle assembly 60. Each heddle assembly 60 includes a top piston 61 which is positioned in one of the cylinders 44 in top piston block 37, a plastic strand 62 which connects the piston 61 in sliding relation to a top piston stopper 63, and a heddle 41 which is formed of wire and has an eye 64 through which a warp yarn 13 extends. The other end of heddle 41 is attached to a bottom piston stopper 65. The bottom piston 66 slides on bottom piston stopper 65 by means of a plastic strand 67.

The overall arrangement is illustrated in the fragmentary view of FIG. 5, where three heddle assemblies 60 are shown in position in the filling insertion zone 15 between the top and bottom piston blocks 37 and 50. Each bottom piston 66 is positioned in a respective bottom cylinder 51 for limited reciprocating movement therein. The air pressure of 4 psi exerts a downward force on the bottom piston 66 thus normally urging it into a downward position which also pulls the top piston 61 to which it is attached through the heddle assembly 60. The top piston stopper 63 stops the downward movement of the bottom piston 66 at the precise point necessary to cause all of the lowered heddle assemblies 60 to form the lower sheet of warp yarns 13 which during any single filling insertion form the lower extent of the filling insertion zone 15.

In a shedding apparatus 30 of the particular configuration shown and disclosed in this application, 5120 of the heddle assemblies function independently under microprocessor control in respective ones of the 5120 cylinders pairs 44 and 51, as described above. An optical encoder on the loom 10 sends a signal to the computer 31 indicating that a pick, i.e., one filling insertion, has been completed. The signal is coded in two parts—an address and an "up or down" signal. The address signal identifies the particular heddle 41 of the 512 heddles in the particular top piston block module 37A–J, and the "up or down" signal indicates whether the heddle assembly 60 is to move up or down in the process of forming the shed. A single microprocessor capable of simultaneously controlling 512 heddle assembly locations is mounted on top of each of the top manifold modules 35A–35J. Each of the microprocessors is controlled by computer 31.

Figure 7:
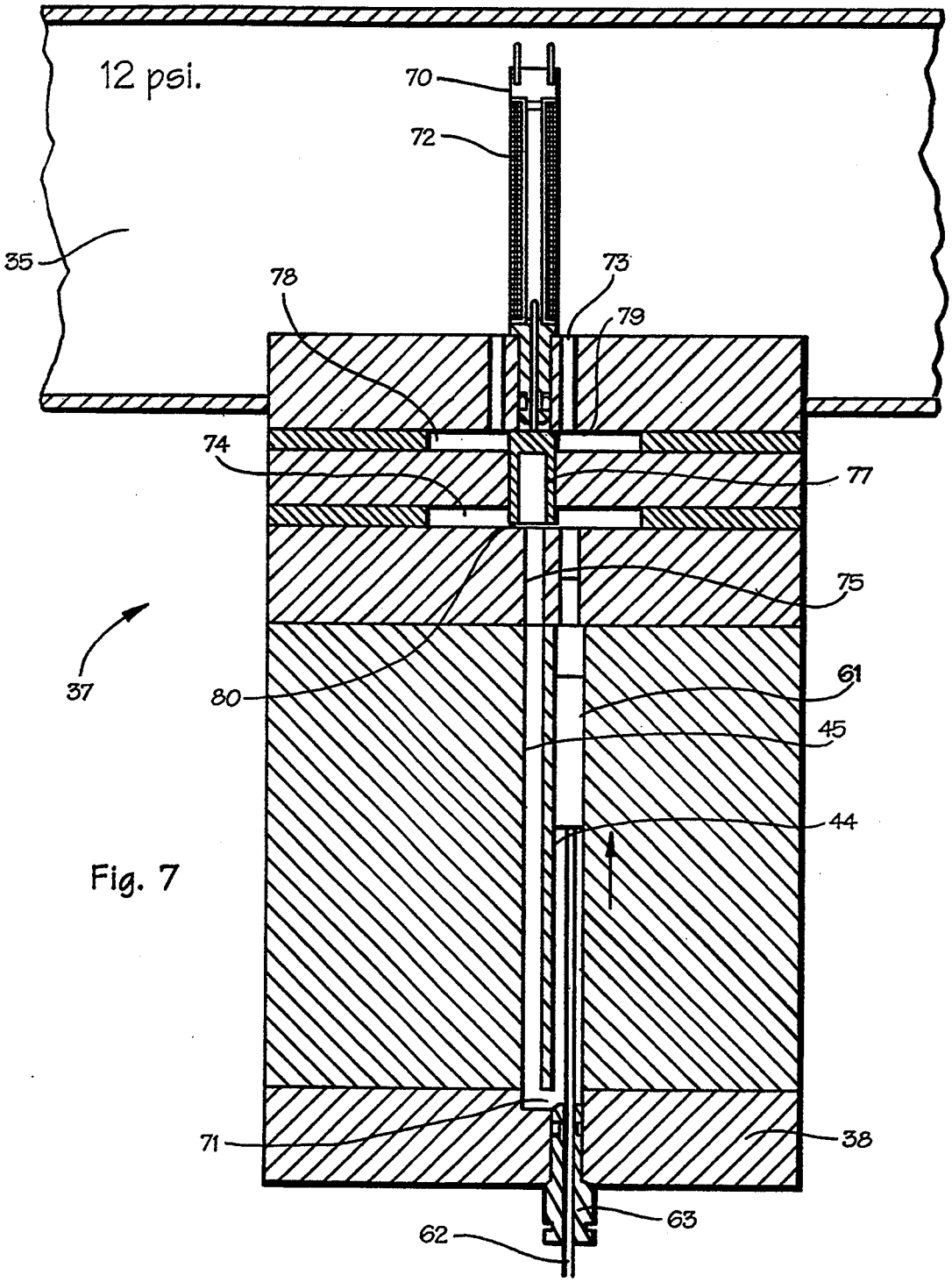
FIG. 7 is a view according to FIG. 6 with the piston and heddle assembly in its "up" position; and FIG. **8*a* is a table including first and second columns of operational test data according to test results of one preferred embodiment of the invention.

Referring to FIGS. 6 and 7, each of the 10 microprocessors controls the pattern formation by activating solenoids 70 which cooperate with the top piston block 37. Each cylinder 44 and vent 45 communicate through a passage 71 in bottom cover 38. A solenoid housing 72 is positioned in the air chamber defined by the sealing engagement of the top manifold 35 with the top piston block 37. Each top piston block 37 contains a top air flow orifice 73, an upper side air flow orifice 78 which directs air flow to plunger 77, and a lower side air flow orifice 74 which communicates with vent 45 through an air passage 75. Solenoid 70 is positioned in the solenoid housing 72 and responds to a control signal from its controlling microprocessor. A spring-loaded plunger 77 reciprocates in air passage under control of solenoid 70. As shown in FIG. 6A, the plunger 77 has several small airways 85 for allowing free passage of air flow through the plunger 77.

In FIG. 6 a heddle assembly 60 is in the "down", or lowered position as is evidenced by the position of piston 61. In this position the heddle 41 forms with other heddles 41 the bottom sheet of warp yarns 13*b* defining the lower extent of the filling insertion zone 15. The heddle assembly 60 reciprocates through two stationary positions, shown in FIGS. 6 and 7, through the operation of the solenoid 70.

In FIG. 6, the solenoid 70 is de-energized. The top piston 61 is in its lowered position. As shown, the upper side air flow orifice 78 is closed and the lower side air flow orifice 74 is open. Air flow through the upper side air flow orifice 78 is blocked by the plunger 77 acting against a seat 79, thus blocking air flow through vent 45 to the rod side of top piston 61. As a result, the top piston 61 is urged downwardly from its up position (as shown in FIG. 7) by a pressure of 4 psi exerted on the bottom piston 66. As the top piston 61 is urged downward, air flow is forced up vent 45 and circulated to the blind side of top piston 61. In this position, the blind side of the piston 61 is open to the atmosphere. Net air flow to the atmosphere is minimal because at any given time, essentially half of the pistons 61 are in their up position while the other half are in their down position.

FIG. 6 shows the top piston 61 in its downward-most position, stopped by piston stopper 63. When in this position, the motion towards lifting the piston 61 and heddle assembly 60 is about to commence, and will commence upon activation of the solenoid 70. This is illustrated in FIG. 7.

In FIG. 7, as the solenoid 70 is activated by the microprocessor, the plunger 77 is urged down on seat 80 sealing off air flow to the lower side air flow orifice 74 and opening air flow to the plunger 77. When the plunger 77 is in this position, air pressure within the top air manifold 35 flows into the top air flow orifice 73 to the upper side air flow orifice 78 and through the plunger 77. Since the lower side air flow orifice 74 is now sealed, air flow to the blind side of piston 61 is likewise sealed. The plunger 77 directs the air flow down vent 45 to the rod side of the piston 61 at a pressure of 12 psi, thereby urging the top piston 61 upwardly against the downward pressure at 4 psi on the bottom piston 66 (see FIG. 4). The top piston's 61 upward movement is stopped by the contact of the bottom piston 66 with the bottom piston stopper 65 shown in FIG. 4.

Relative dimensions in millimeters associated with the top manifold 35 and top piston block 37 are indicated in FIGS. 6 and 7. The indicated dimensions are provided by way of example only, and are in no way intended to limit the scope of the invention.

At any given time some of the 5120 heddles 41 will be in the upper position and the remainder in the lower position. While in this position, a filling yarn is inserted from one side to the other of the filling insertion zone 15.

The next signal from the microprocessors will cause a predetermined shift in the heddles 41 according to the pattern stored in the computer 31, whereby the warp yarns 13 shift to form a new pattern, with a different arrangement of warp yarns 13 forming the upper and lower extent of the filling insertion zone 15.

As noted above, the operational limit for cam-controlled Jacquard looms is approximately 600 ppm, or about one shedding motion for each time interval of 100 milliseconds. The speed with which sheds can be formed has historically been the limiting factor as far as loom speed is concerned.

Figures 8A, 8B:
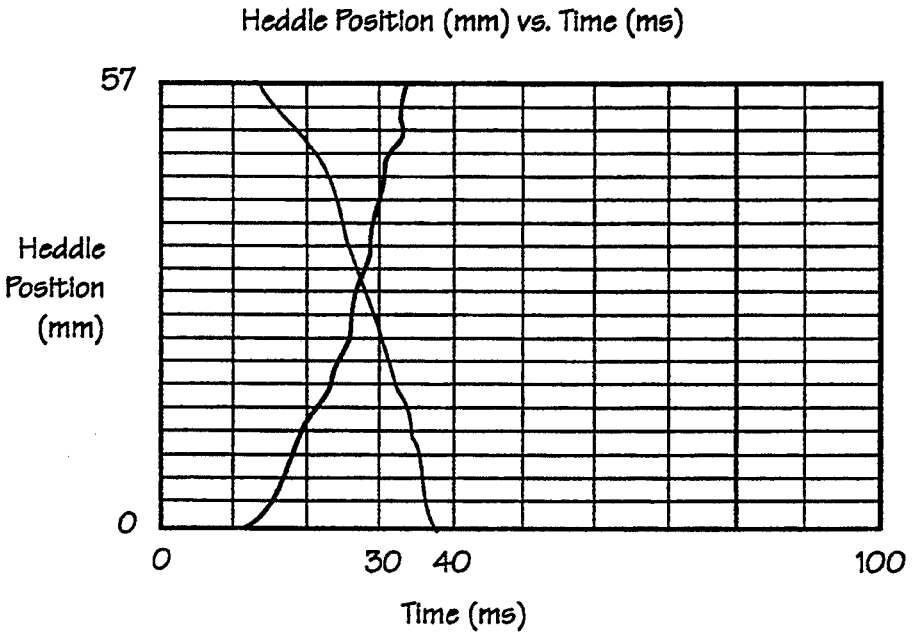
FIG. 8*b* is a graph illustrating the position of the heddle throughout the shedding motion verses time according to the test data of FIG. 8*a***.

FIG. 8*a* is a table including first and second columns of operational test data according to a preferred embodiment of the shedding apparatus 30. The first column, headed "Bottom to Top" demonstrates the time in milliseconds required for the piston and heddle assembly to move from a down position shown in FIG. 6 to an up position shown in FIG. 7. Thus, 9.47 milliseconds was needed to initiate the upward movement of the heddle 41 from the down position, and a total of 33.90 milliseconds was required to move the heddle through one shedding motion from the down position to the up position. The second column, headed "Top to Bottom" demonstrates the time in milliseconds required for the piston and heddle assembly to move from the up position shown in FIG. 7 back to the down position shown in FIG. 6. Thus, 12.50 milliseconds was required to initiate the downward movement of the heddle 41 from the up position, and a total of 36.86 milliseconds was required to move the heddle 41 through one shedding motion from the up position back to the down position.

As is shown in the graph of FIG. 8*b*, a shedding motion using the shedding apparatus 30 of this application was completed in between 35 and 40 milliseconds. Thus, a loom using shedding apparatus 30 can form sheds almost three times faster than with a conventional cam-controlled shedding motion. A like increase in the filling insertion rate results in a loom which can operate at approximately 1500 ppm.

It is also possible to utilize the bottom piston block 50 and associated components to provide "return" force to lower heddles 41 in a loom 10 wherein other means, such as cams or levers, actually control the upward movement of the heddles 41 to form the shed. In this embodiment, of course, the air pressure needed to provide the required return force would be calculated based on the force exerted on the heddles 41 in the upward cycle of movement. Such a system would be much quieter and would have considerably fewer moving parts than other systems utilizing springs, for example.

A shedding apparatus is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A shedding apparatus for being fitted onto a fabric-forming machine for controlling the up and down movement of warp-carrying heddles to form a filling insertion shed, said shedding apparatus comprising:

(a) pattern information storage means for storing a predetermined pattern to be translated into a woven pattern on the fabric-forming machine;

(b) a plurality of pneumatic piston and cylinder assemblies for being attached to respective heddles for pneumatically moving the heddle attached thereto into and out of shed-forming position; and (c) pattern information conveying means for being operatively associated with said pattern storage means and responsive to said pattern storage means for delivering pressurized air to predetermined piston and cylinder assemblies to thereby move the selected piston and cylinder assemblies and their respective heddles into upper and lower shed-forming positions to receive a filling yarn to thereby create a portion of the pattern stored in the pattern information storage means; and (d) a piston block for housing said piston and cylinder assemblies, said piston block defining a plurality of cylinders formed therein for receiving a respective piston for pneumatically induced shed-forming movement therein between said upper and said lower shed-forming positions.

2. A shedding apparatus according to claim 1, and including a first pneumatic manifold pneumatically co-operating with said pneumatic piston and cylinder assemblies and said pattern information conveying means for maintaining a pressurized air supply for use by each of the pneumatic piston and cylinder assemblies to move the selected piston and cylinder assemblies and their respective heddles into the upper shed-forming position to receive a filling yarn.

3. A shedding apparatus according to claim 2, and including piston and cylinder assembly return means comprising a second pneumatic manifold for maintaining a pressurized air supply for use by each of the pneumatic piston and cylinder assemblies to move the selected piston and cylinder assemblies and their respective heddles into the lower shed-forming position to receive a filling yarn.

4. A shedding apparatus according to claim 1, wherein said pattern storage means comprises a computer having digital storage means and data reading means for reading digital data representing the predetermined pattern from storage, and wherein said pattern conveying means comprises a plurality of solenoids operatively associated with said computer and with the respective plurality of piston and cylinder assemblies.

5. A shedding apparatus according to claim 1, each one of said pneumatic piston and cylinder assemblies comprises:

(a) a top manifold for maintaining a supply of air;

(b) a bottom manifold for maintaining a supply of air, said bottom manifold being vertically spaced-apart from said top manifold and defining a shed-forming space therebetween wherein the heddles move upwardly and downwardly to form successive filling insertion sheds as weaving proceeds;

(c) a top piston block positioned in pneumatic communication with said top manifold, said top piston block having a plurality of cylinders formed therein;

(d) a top piston positioned in each of said cylinders for pneumatically-induced movement therein;

(e) a bottom piston block positioned in pneumatic communication with said bottom manifold, said bottom piston block having a plurality of cylinders formed therein;

(f) a bottom piston positioned in each of said cylinders for pneumatically-induced movement therein; and (g) interconnection means for interconnecting one of said top pistons and one of said bottom pistons for unison, pneumatically-induced shed-forming movement of the top and bottom pistons, said interconnection means including a heddle.

6. A method of forming a shed on a fabric-forming machine comprising the steps of:

(a) storing a predetermined pattern to be translated into a fabric pattern on the fabric-forming machine, said pattern storing step comprising the substeps of providing a computer having digital storage means, and storing an electromagnetic representation of the pattern in the digital storage means; and (b) delivering pressurized air to predetermined warp yarn-carrying heddles in correlation with the pattern to thereby move the heddles and the warp yarn carried thereby into upper and lower shed-forming positions to receive a filling yarn to thereby create a portion of the pattern stored in the pattern information storage means, said air delivering step comprising the sub-steps of:

(1) providing data reading means for reading digital data from the digital storage means;

(2) providing a plurality of solenoids operatively associated with said computer and With the heddles; and (3) activating said solenoids in response to data read from said digital storage device to deliver pressurized air to heddles in a pattern corresponding to the pattern of the warp yarn of the fabric to be woven.

7. A method according to claim 6, wherein the step of activating the solenoids comprises the step of providing piston and cylinder assemblies housed in a piston block, said piston block defining a plurality of cylinders formed therein for receiving a respective piston which is interconnected with a respective heddle for inducing movement of the heddle.

8. A fabric-forming machine for inserting yarn into a filling insertion shed, said fabric-forming machine comprising:

(a) warp yarn delivery means for delivering warp yarns to a filling yarn insertion zone;

(b) filling yarn delivery means for delivering filling yarns to the filling yarn insertion zone for integration with warp yarns delivered to the filling yarn insertion zone to form a fabric;

(c) fabric removal means for progressively removing the fabric formed from the filling yarn insertion zone;

(d) shed-forming means for forming a filling insertion shed in the filling yarn insertion zone, said shed-forming means comprising:

(1) pattern information storage means for storing a predetermined pattern to be translated into a woven pattern on the fabric-forming machine;

(2) a plurality of pneumatic piston and cylinder assemblies for being attached to respective heddles for pneumatically moving the heddle attached thereto into and out of shed-forming position; and (3) pattern information conveying means for being operatively associated with said pattern information storage means and responsive to said pattern information storage means for delivering pressurized air to predetermined piston and cylinder assemblies to thereby move the selected piston and cylinder assemblies and their respective heddles into upper and lower shed-forming positions to receive a filling yarn to thereby create a portion of the pattern stored in the pattern information storage means;

(e) a piston block for housing said piston and cylinder assemblies, said piston block defining a plurality of cylinders formed therein for receiving a respective piston for pneumatically induced shed-forming movement therein between said upper and said lower shed-forming positions.

9. A fabric-forming machine according to claim 8, and including a first pneumatic manifold means pneumatically cooperating with said pneumatic piston and cylinder assemblies and said pattern information conveying means for maintaining a pressurized air supply for use by each of the pneumatic piston and cylinder assemblies to move the selected piston and cylinder assemblies and their respective heddles into the upper shed-forming position to receive a filling yarn.

10. A fabric-forming machine according to claim 9, and including piston and cylinder assembly return means comprising a second pneumatic manifold for maintaining a pressurized air supply for use by each of the pneumatic piston and cylinder assemblies to move the selected piston and cylinder assemblies and their respective heddles into the lower shed-forming position to receive a filling yarn.

11. A fabric-forming machine according to claim 8, wherein said pattern storage means comprises a computer having digital storage means and data reading means for reading digital data representing the predetermined pattern from storage, and wherein said pattern conveying means comprises a plurality of solenoids operatively associated with said computer and with the respective plurality of piston and cylinder assemblies.

12. A fabric-forming machine according to claim 8, wherein said pneumatic piston and cylinder assembly comprises:

(a) a top manifold for maintaining a supply of air;

(b) a bottom manifold for maintaining a supply of air, said bottom manifold being vertically spaced-apart from said top manifold and defining a shed-forming space therebetween wherein the heddles move upwardly and downwardly to form successive filling insertion sheds as weaving proceeds;

(c) a top piston block positioned in pneumatic communication with said top manifold, said top piston block having a plurality of cylinders formed therein;

(d) a top piston positioned in each of said cylinders for pneumatically-induced movement therein;

(e) a bottom piston block positioned in pneumatic communication with said bottom manifold, said bottom piston block having a plurality of cylinders formed therein;

(f) a bottom piston positioned in each of said cylinders for pneumatically-induced movement therein; and (g) interconnection means for interconnecting one of said top pistons and one of said bottom pistons for unison, pneumatically-induced shed-forming movement of the top and bottom pistons, said interconnection means including a heddle.

13. A method of forming a fabric on a fabric-forming machine which uses heddles to form a filling insertion shed, comprising the steps of:

(a) storing a predetermined pattern to be translated into a fabric pattern, said pattern storing step comprising the sub-steps of providing a computer having digital storage means, and storing an electromagnetic representation of the pattern in the digital storage means;

(b) delivering warp yarns to a filling yarn insertion zone;

(c) delivering pressurized air to air-responsive movement means associated with predetermined heddles positioned at the filling yarn insertion zone in correlation with the pattern to thereby move the heddles into upper and lower shed-forming positions in the filling insertion zone to receive a filling yarn to thereby create in a fabric the stored predetermined pattern, said air delivering step comprising the sub-steps of:

(1) providing data reading means for reading digital data from the digital storage means;

(2) providing a plurality of solenoids operatively associated with said computer and with the heddles;

(3) activating said solenoids in response to data read from said digital storage device to deliver pressurized air to heddles in a pattern corresponding to the pattern of the warp of the fabric to be woven;

(d) delivering filling yarns to the filling yarn insertion zone;

(e) inserting the filling yarns into the filling yarn insertion zone; and (f) integrating the filling yarns with the warp yarns to form a fabric.

14. A method according to claim 13, wherein the step of activating the solenoids comprises the step of providing piston and cylinder assemblies housed in a piston block, said piston block defining a plurality of cylinders formed therein for receiving a respective piston which is interconnected with a respective heddle for inducing movement of the heddle.

15. A method according to claim 13, wherein the step of integrating the filling yarns and warp yarns to form the fabric comprises the step of forming a flat woven fabric.

16. A shedding apparatus for being fitted onto a fabric-forming machine for controlling the up and down movement of warp-carrying heddles to form a filling insertion shed, said shedding apparatus comprising:

(a) a plurality of piston and cylinder assemblies including respective top and bottom pistons for being interconnected by respective heddles, said top piston for moving the heddle attached thereto into an upper shed-forming position; and (b) pneumatic piston and cylinder assembly return means including a pressurized air supply operatively communicating with each of the bottom pistons to pneumatically move the selected bottom piston and heddle attached thereto into a lower shed forming position, said upper and lower shed forming positions collectively defining therebetween the filling insertion shed for receiving a filling yarn.

17. A shedding apparatus for being fitted onto a fabric-forming machine for controlling the up and down movement of warp-carrying heddles to form a filling insertion shed, said shedding apparatus comprising:

(a) a plurality of pneumatic piston and cylinder assemblies including respective top and bottom pistons for being interconnected by respective heddles, said top piston for pneumatically moving the heddle attached thereto into a first shed-forming position; and (b) pneumatic piston and cylinder assembly return means including a pressurized air supply operatively communicating with each of the bottom pistons to move the selected bottom piston and heddle attached thereto into a second shed forming position, said first and second shed forming positions collectively defining therebetween the filling insertion shed for receiving a filling yarn.

* * * * *